US005967045A

United States Patent [19]

Staiger et al.

[11] Patent Number: 5,967,045

[45] Date of Patent: Oct. 19, 1999

[54] INK DELIVERY PRESSURE CONTROL

[75] Inventors: Thomas J. Staiger, Hastings; Charles L. Rennolet, St. Paul; John R. Hofmann, Lino Lakes, all of Minn.

[73] Assignee: Imation Corp., Oakdale, Minn.

[21] Appl. No.: 09/175,662

[22] Filed: Oct. 20, 1998

[51] Int. Cl.[6] ..... B41F 31/02

[52] U.S. Cl. ..... 101/366; 346/140; 346/75; 346/1.1

[58] Field of Search ..... 346/140, 75, 1.1; 101/366; 239/101; 347/19

[56] References Cited

U.S. PATENT DOCUMENTS

| | | | |
|---|---|---|---|
| 3,747,120 | 7/1973 | Stemme | 346/75 |
| 3,848,118 | 11/1974 | Rittberg | 239/101 |
| 3,940,773 | 2/1976 | Mizoguchi et al. | 346/140 |
| 3,988,745 | 10/1976 | Sultan | 346/140 |
| 4,287,523 | 9/1981 | Thomas et al. | 346/140 |
| 4,471,364 | 9/1984 | Kocot . | |
| 4,571,599 | 2/1986 | Rezanka . | |
| 4,636,814 | 1/1987 | Terasawa . | |
| 4,862,192 | 8/1989 | Slomianny | 346/75 |
| 4,967,207 | 10/1990 | Ruder . | |
| 4,968,998 | 11/1990 | Allen . | |
| 5,170,177 | 12/1992 | Stanley et al. | 346/1.1 |
| 5,212,497 | 5/1993 | Stanley et al. | 346/1.1 |
| 5,233,369 | 8/1993 | Carlotta et al. . | |
| 5,245,365 | 9/1993 | Woodard et al. . | |
| 5,270,739 | 12/1993 | Kitani et al. . | |
| 5,367,328 | 11/1994 | Erickson . | |
| 5,369,429 | 11/1994 | Erickson . | |
| 5,469,201 | 11/1995 | Erickson et al. . | |
| 5,486,855 | 1/1996 | Carlotta et al. . | |
| 5,488,400 | 1/1996 | Crystal et al. . | |
| 5,502,468 | 3/1996 | Knierim | 347/19 |
| 5,510,820 | 4/1996 | Aulick et al. . | |
| 5,541,632 | 7/1996 | Khodapanah et al. . | |
| 5,589,862 | 12/1996 | Ujita et al. . | |

FOREIGN PATENT DOCUMENTS

| | | |
|---|---|---|
| 0 655 335 A2 | 5/1995 | European Pat. Off. . |
| WO 96/34761 | 11/1996 | WIPO . |

*Primary Examiner*—Edgar Burr
*Assistant Examiner*—Charles H. Nolan, Jr.
*Attorney, Agent, or Firm*—William D. Bauer

[57] ABSTRACT

For control of static ink delivery pressure, a system and method make use of an outer chamber having a first outlet for delivery of ink to an ink printing mechanism, an inner chamber having a second outlet for delivery of ink to the outer chamber, and a pressure source that applies negative pressure to the outer chamber. The inner chamber maintains an internal negative pressure that is selected to control a level of the ink within the outer chamber relative to a height of the second outlet within the outer chamber. In particular, inner chamber maintains the ink level at a substantially constant level by replenishing the volume of ink within the outer chamber upon consumption. When ink is consumed by the ink printing mechanism, the inner chamber delivers a proportional volume of ink to the outer chamber that is sufficient to restore the ink to the desired level. The negative pressure applied to the outer chamber is operative on the substantially constant volume of ink maintained within the outer chamber, and can be readily selected to provide a substantially uniform static ink delivery pressure from the outer chamber to the ink printing mechanism. For an inkjet printhead, the level of negative pressure applied to the outer chamber serves to control static nozzle pressure to avoid excessive wetting that can adversely affect jetting characteristics. The level of negative pressure can be selected based on the physical characteristics of the ink, the printing mechanism, or both.

30 Claims, 2 Drawing Sheets

INK DELIVERY PRESSURE CONTROL

TECHNICAL FIELD

The present invention relates to ink printing systems and, more particularly, to techniques for controlling ink delivery pressure.

BACKGROUND INFORMATION

In an ink printing system, ink generally is delivered from an ink supply to a printing mechanism such as an inkjet printhead. In some systems, the ink supply and printing mechanism may be integrated with one another in a unitary package or module. The ink supply and printing mechanism in other systems are manufactured as discrete components to enable the ink supply to be separately replaced or replenished without removing the printing mechanism. In either case, the delivery of ink from the ink supply to the printing mechanism requires careful control. In particular, the volume and pressure of ink delivered to the printing mechanism must be controlled to avoid flow irregularities that can cause artifacts and degrade image quality.

Excessive static pressure, for example, can cause undue wetting that saturates the nozzle plate of an inkjet printhead during an inactive period. Excessive wetting at the nozzle plate can adversely affect the jetting characteristics of the inkjet printhead, causing imprecise jetting of the ink droplets to the print medium or preventing jetting altogether. At the same time, ink consumption is increased, requiring more frequent replenishment or replacement of the ink supply. Moreover, maintenance of consistent static pressure can be undermined by the physical characteristics of different inks, print mechanisms, or print media. Accordingly, ink delivery pressure control remains a challenge in the design of an ink printing system.

SUMMARY

The present invention is directed to a system and method for controlling the delivery of ink to an ink printing mechanism. The system and method are particularly useful in controlling ink delivery pressure in an inkjet printing system. For example, the system and method can be adapted to control delivery of ink to a drop-on-demand inkjet printhead. The system and method may find application, however, in other printing systems that require controlled delivery of liquid ink to a printing mechanism.

The system and method make use of a dual-chamber ink supply. The ink supply includes an inner chamber that serves as an ink supply reservoir, and an outer chamber that receives ink from the inner chamber for delivery to the ink printing mechanism. Negative pressure within the inner chamber controls the amount of ink delivered to the outer chamber, and provides a consistent level of ink within the outer chamber independently of the amount of ink remaining in the ink supply reservoir, i.e., the inner chamber. In other words, the level of ink in the outer chamber remains substantially constant despite consumption of the ink. Application of negative pressure to the outer chamber, in combination with the maintenance of a consistent ink level, allows for more uniform static pressure at the output of the ink printing mechanism, e.g., at the nozzle of an inkjet printhead.

Static pressure refers to the pressure exerted on the ink at the printhead outlet during an inactive period, i.e., a period in which the inkjet printhead is not actively jetting such as between regular jetting intervals or when the printhead is idle. The static pressure is the product of a number of factors including the negative pressure applied to the outer chamber, the negative pressure applied to the inner chamber, gravitational forces acting on the ink, and surface tension of the ink. In generally, the negative pressure in the inner chamber combines with the surface tension of the ink to resist the negative pressure in the outer chamber and gravitational forces. The static pressure at the printhead outlet is overcome by controlled impulse pressure when the inkjet printhead is driven to eject ink droplets. However, maintenance of a uniform, and typically negative, static pressure during inactive periods avoids excessive ink wetting at the nozzle plate that can degrade image quality during jetting. The static pressure can be slightly positive, particularly if capillary forces at the inkjet nozzles aid in avoiding wetting of the nozzle plate.

In one embodiment, the present invention provides a system for controlling delivery of ink to an ink printing mechanism, the system comprising an outer chamber having a first outlet for delivery of ink from the outer chamber to an ink printing mechanism, an inner chamber having a second outlet disposed within the outer chamber for delivery of the ink from the inner chamber to the outer chamber, wherein the inner chamber is negatively pressurized to control a level of the ink within the outer chamber, and a pressure source that provides negative pressure to the outer chamber to control a static pressure of the ink delivered to the ink printing mechanism.

In another embodiment, the present invention provides a method for controlling delivery of ink to an ink printing mechanism, the method comprising delivering ink from a first outlet of an outer chamber to an ink printing mechanism, delivering ink from a second outlet of an inner chamber to the outer chamber, the inner chamber having a level of negative pressure that controls a level of the ink within the outer chamber, and applying negative pressure to the outer chamber to control a static pressure of the ink delivered to the ink printing mechanism.

In a further embodiment, the present invention provides a system for controlling delivery of ink to an ink printing mechanism, the system comprising an outer chamber for delivery of ink to an ink printing mechanism, an inner chamber for delivery of ink to the outer chamber, wherein the inner chamber is negatively pressurized to maintain a substantially constant level of ink within the outer chamber, and a pressure source that applies negative pressure to the outer chamber to control a static pressure of the ink delivered to the ink printing mechanism.

In an added embodiment, the present invention provides a method for controlling delivery of ink to an ink printing mechanism, the method comprising delivering ink from a first outlet of an outer chamber to an ink printing mechanism, delivering ink from a second outlet of an inner chamber to the outer chamber, the inner chamber having a level of negative pressure that helps maintain a substantially constant level of ink within the outer chamber, and applying negative pressure to the outer chamber to control a static pressure of the ink delivered to the ink printing mechanism.

In another embodiment, the present invention provides a system for controlling delivery of a fluid to an ink printing mechanism, the system comprising an outer chamber for delivery of fluid to an ink printing mechanism, an inner chamber for delivery of fluid to the outer chamber, wherein the inner chamber is negatively pressurized to maintain a substantially constant level of fluid within the outer chamber, and a pressure source that applies negative pressure to the outer chamber to control a static pressure of the fluid delivered to the ink printing mechanism.

In an additional embodiment, the present invention provides a method for controlling delivery of fluid to an ink printing mechanism, the method comprising delivering fluid from a first outlet of an outer chamber to an ink printing mechanism, delivering fluid from a second outlet of an inner chamber to the outer chamber, the inner chamber having a level of negative pressure that helps maintain a substantially constant level of fluid within the outer chamber, and applying negative pressure to the outer chamber to control a static pressure of the fluid delivered to the ink printing mechanism.

An inkjet printhead, for example, is characterized by a static nozzle pressure representative of the pressure of ink at the output nozzle during an inactive period. The static nozzle pressure is determined by the level of pressure exerted by the inkjet printhead on ink delivered from the outer chamber, and the level of the negative pressure applied to the outer chamber by the pressure source. To control static nozzle pressure in a consistent manner, the system and method can make use of a pressure source that is selectively adjustable to control the level of negative pressure applied to the outer chamber. The pressure source can be selectively adjustable to control the level of the negative pressure based on physical characteristics of the ink, the inkjet printhead, or both.

The level of negative pressure applied to the inner chamber also can be selected such that, upon delivery of an amount of ink from the outer chamber to the ink printing mechanism, a corresponding amount of ink is delivered from the inner chamber to the outer chamber. In this manner, the negative pressure can be selected to maintain a consistent level of the ink within the outer chamber, e.g., at a level substantially equivalent to a height of the second outlet within the outer chamber. With a consistent ink level and consistent negative pressure within the outer chamber, the static nozzle pressure of the inkjet printhead can be controlled to provide uniform jetting of ink from the nozzle. This uniformity can significantly improve image quality.

To facilitate a substantially constant level of ink within the outer chamber, the second outlet can be sized such that, when the level of ink within the outer chamber recedes, retention force generated by the surface tension of ink within the second outlet is overcome by gravitational forces on the ink, thereby allowing delivery of ink from the inner chamber to the outer chamber. Also, the second outlet may have a cross-sectional plane that extends upward relative to the lower portion of the inner chamber such that the second outlet includes a lowermost point and an uppermost point. In this case, the level of negative pressure within the inner chamber can be selected to control the level of the ink at a height substantially equivalent to a height of the uppermost point of the second outlet. The height can be selected to reside below the height of the uppermost point depending on the amount of force desired to overcome the force generated by the surface tension of the ink in the inner chamber. The cross-sectional area and/or angled orientation of the second outlet can be varied for different ink surface tensions. In this manner, the balance between counteracting forces at the second outlet can be adjusted. In particular, with other forces held constant, a larger cross-sectional area at the second outlet generally will promote flow of ink out of the inner chamber. In addition, the inner chamber can be provided with selected materials or coatings having surface energies that either promote or deter de-wetting of ink from the inside walls of the inner chamber.

The inner chamber may have a closed upper portion and an open lower portion defined by the second outlet. In this case, the inner chamber holds a finite amount of ink and opens downward to deliver the ink to the outer chamber. Thus, the inner and outer chambers can be constructed in the form of an integrated cartridge that is replaced or replenished when the inner cartridge is empty. As an alternative, the inner chamber may include an ink supply reservoir disposed outside of the outer chamber and a delivery conduit extending between the ink reservoir and the second outlet. The conduit delivers ink from the ink reservoir to the outer chamber via the second outlet. With this alternative arrangement, the ink reservoir can be replenished or replaced on a less frequent basis, maintaining a "bulk" supply of ink without the need to remove the second outlet from the outer chamber. In either case, the system and method can be adapted for a preconfigured inkjet printhead or retrofitted to a commercially available inkjet printhead having an ink supply inlet. Further, the system and method may be useful for delivery of other fluids, such as solvents, to an ink printing mechanism, e.g., in a cleaning mode.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

Figure 1:
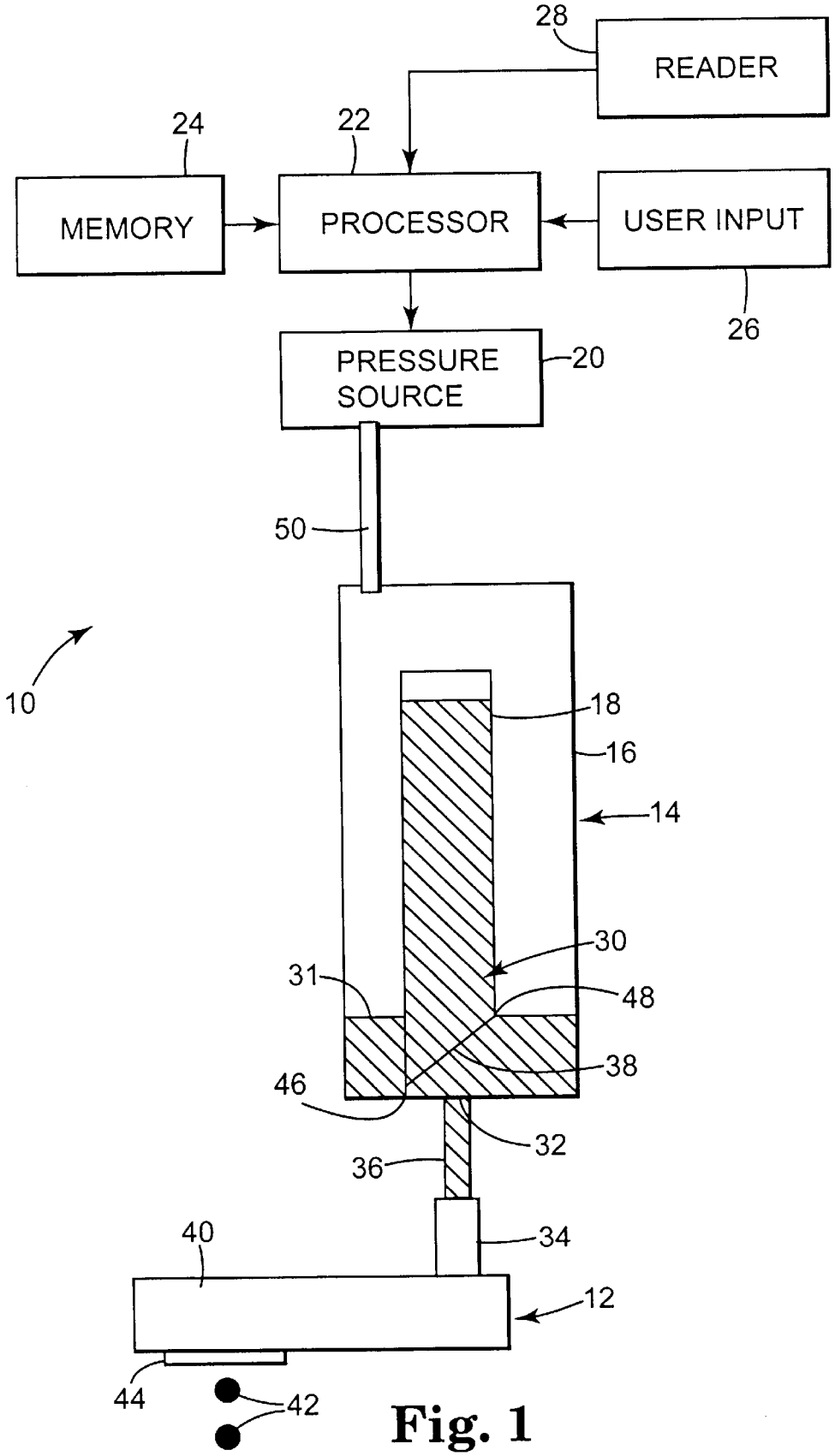
FIG. 1 is a diagram of a system for controlling ink delivery pressure in a printing system.

FIG. 1 is a diagram of a system 10 for controlling ink delivery pressure in a printing system. System 10 is suitable for practice of a method for controlling ink delivery pressure in accordance with an embodiment of the present invention. As shown in FIG. 1, system 10 may include an ink printing mechanism 12, an ink delivery cartridge 14 having an outer chamber 16 and an inner chamber 18, a negative pressure source 20, a processor 22, memory 24, a user input device 26, and a reader device 28. Inner chamber 18 serves as an ink supply reservoir containing a finite amount of ink 30. Outer chamber 16 receives ink 30 from inner chamber 18 for delivery to ink printing mechanism 12. Use of a dual-chamber ink cartridge 14 and selective application of negative pressure within outer chamber 16 and inner chamber 18 allow static ink delivery pressure to ink printing mechanism 12 to be maintained at a substantially constant level.

Negative pressure within inner chamber 18 controls the amount of ink delivered to outer chamber 16, and the resultant level of ink within the outer chamber. The level 31 of ink 30 can be maintained independently of the amount of ink remaining within the ink supply reservoir, i.e., the inner chamber. In other words, the level of ink in outer chamber 16 remains substantially constant despite consumption of the ink contained within inner chamber 18. Application of negative pressure to outer chamber 16, in combination with the maintenance of a consistent ink level, allows for more uniform static pressure delivered to the output of ink printing mechanism 12.

In particular, static pressure at the output of ink printing mechanism 12 can be controlled during periods in which ink printing mechanism 12 is not actively emitting ink. Uniform static pressure generally avoids excessive ink wetting at the output of ink printing mechanism 12, which can degrade image quality. Inner chamber 18 can be filled with ink in an upright position, e.g., with a syringe, squeeze bulb, or fluid line, and then turned upside-down within outer chamber 16. In this case, the volume and diameter of inner chamber 18 are selected such that the ink is retained by surface tension and intrinsic negative pressure within the inner chamber. Alternatively, inner chamber 18 can be partially evacuated to actively provide or increase the desired level of internal negative pressure. A valve or other fitting can be provided in inner chamber 18 to allow evacuation of air.

Pressure source 20 then can be provided to apply the desired level of negative pressure to outer chamber 16. Pressure source 20 can be realized, for example, by a vacuum pump, fan, aspirator, or other device sufficient to generate a desired level of negative pressure within outer chamber 16. With the negative pressure applied by pressure source 20 operative on a substantially constant volume of ink 30 within outer chamber 16, substantially uniform static delivery pressure to printing mechanism 12 can be readily maintained. This static delivery pressure typically will be negative to retain ink within printing mechanism 12. However, a slightly positive pressure may be effective, particularly if capillary or other forces in the outlet of printing mechanism 12 assist in ink retention.

As an example, system 10 may be used with an inkjet printer. In this case, system 10 may control ink delivery pressure to a nozzle associated with an inkjet printhead. Accordingly, ink printing mechanism 12 may take the form of an inkjet printhead, such as a drop-on-demand printhead. For a drop-on-demand printhead, ink printing mechanism may make use of piezo, thermal, or other drop-on-demand inkjet technologies. In this case, system 10 is useful in achieving a substantially uniform static pressure at the nozzle plate of the printhead. In this manner, system 10 can prevent excessive wetting of the nozzle plate during periods in which the printhead is not jetting ink, i.e, when the printhead is idle or between regular jetting intervals during the course of a print job. Excessive wetting at the nozzle plate can adversely affect the jetting characteristics of the inkjet printhead, causing imprecise jetting of the ink droplets to the print medium or preventing jetting altogether. System 10 conceivably could be adapted for other printers that require controlled delivery of liquid ink to a printing mechanism. For purposes of illustration, however, use of system 10 with an inkjet printer will be described, and ink printing mechanism 12 hereinafter will be referred to as an inkjet printhead.

With further reference to FIG. 1, outer chamber 16 is generally closed, but has a first outlet 32 for delivery of ink 30 to inkjet printhead 12. First outlet 32 delivers ink 30 to an inlet 34 on inkjet printhead 12 via an ink delivery conduit 36. Inner chamber 18 is disposed within outer chamber 16, and serves as an ink supply reservoir that delivers ink 30 to the outer chamber. In particular, inner chamber 18 also is generally closed, but includes a second outlet 38 that is formed in a lower portion of the inner chamber. Second outlet 38 is oriented to deliver ink 30 downward into outer chamber 16. Outer chamber 16, in turn, delivers ink 30 to inkjet printhead 12.

As ink is consumed and the level of ink within outer chamber 16 drops, inner chamber 18 provides additional amounts of ink to replenish the supply. The additional amount of ink 30 provided is a function of the negative pressure within inner chamber 18 and the level of the remaining ink within outer chamber 16 relative to the height of second outlet 38. Upon replenishment, a substantially constant volume of ink 30 is maintained within outer chamber 16 at a level approximately equivalent to the height of second outlet 38. Although inner chamber 18 is illustrated as occupying a vertical orientation in FIG. 1, it could be oriented at an angle relative to vertical so long as second outlet 38 is positioned to deliver ink to replenish outer chamber 16.

Inkjet printhead 12 further includes a printhead housing 40 that contains conventional electromechanical or electrothermal hardware for controlling the jetting of ink droplets 42 from a nozzle plate 44. Nozzle plate 44 may define a nozzle array for emission of ink droplets 42 in a one- or two-dimensional pattern. Inkjet printhead 12 may conform to any of a variety of conventional and commercially available inkjet printheads that are preconfigured or retrofitted with an inlet 34 to accept ink 30 from ink delivery conduit 36 as shown in FIG. 1. Such inkjet printheads may include drop-on-demand printheads. Examples of commercially available inkjet printheads that can be readily adapted for use with system 10 include a variety of piezo heads available from Epson America, Inc., e.g., in the Stylus series of printers. Other commercially available inkjet printheads can be adapted for use with system 10 following minimal modification, such as the 51640, 51645, 51626, and 51629 printheads available from Hewlett-Packard.

Also, system 10 may be configured for use with a number of different printheads on a selective basis, by connection or installation of cartridge 14 with a new printhead, or vice versa. For example, installation may simply involve the connection of conduit 36 to inlet 34 of an inkjet printhead 12. Further, cartridge 14, with inner and outer chambers 16, 18, can be configured as an integrated and self-contained assembly that operates as a traveling "mini-reservoir" appropriate for use in a traversing carriage system. Specifically, cartridge 14 could be constructed to be carried along with inkjet printhead 12 during the printing process. Pressure source 20 then could be coupled to cartridge 14 with an elongated, flexible conduit. Alternatively, pressure source 20 itself could be self-contained, preset at a desired level of negative pressure, and mounted to ride with cartridge 14 and inkjet printhead 12. Again, pressure source 20 could take the form of a fan, vacuum pump, aspirator, or other suitable device.

The level of negative pressure within inner chamber 18 is selected such that, upon delivery of an amount of ink 30 from outer chamber 16 to inkjet printhead 12, a corresponding amount of ink is delivered from the inner chamber to the outer chamber. In this manner, inner chamber 18 restores the level of ink within outer chamber 16 to a level substantially equivalent to the height of second outlet 38 within the outer chamber. Thus, the level of ink 30 within outer chamber 16 can be controlled by adjusting the height of second outlet 38 within the outer chamber. As ink 30 is consumed by inkjet printhead 12 and the ink level recedes below second outlet 38, an air bubble forms at the second outlet and moves upward into inner chamber 18, releasing a proportional volume of ink out into outer chamber 16.

Again, inner chamber 18 can be filled with ink 30 up to a desired level and then turned upside-down or partially evacuated via a valve to set internal negative pressure at the desired level. In the case in which inner chamber 18 is simply turned upside-down, the level of internal negative pressure will be determined by the volume and diameter of the inner chamber. The resulting volume of ink delivered by inner chamber 18 causes the ink level to rise to the level of second outlet 38, at which point the delivery of ink 30 from inner chamber 18 is restricted. Thus, inner chamber 18 replenishes the amount of ink within outer chamber 16 to provide a consistent ink level despite differences in the volume of ink within inner chamber 18.

The cross-sectional area, e.g., diameter, of second outlet 38 can be selected such that the surface tension of ink within inner chamber 18 is overcome when the ink level recedes below the second outlet by a predetermined degree. In other words, the amount of force necessary to overcome the surface tension is influenced by the diameter of second outlet 38. A slight decrease in the ink level relative to the height of second outlet 38 will be sufficient for an air bubble to overcome the counter-gravitational forces generated by the surface tension of the ink at the second outlet. A smaller diameter may require a larger drop in the ink level below the height of second outlet 38 to overcome the force generated by the surface tension of the ink. A larger diameter at second outlet 38 will generally result in a smaller threshold force necessary to overcome the surface tension.

An increase in the diameter of second outlet 38 reduces the effects of surface tension of the particular ink, providing less resistance to gravitational forces working on the ink. With a larger diameter at second outlet 38, less force is necessary to break the surface tension of the ink at second outlet 38. Thus, the response of inner chamber 18 in replenishing the ink 30 in outer chamber 16 can be adjusted in part by selection of the second outlet diameter. Selection of outlet diameter can be made, for example, based on the fluid characteristics of different inks, e.g., viscosity, density, surface tension. In addition, it may be possible to further control the replenishment response of inner chamber 18 by selecting materials or coatings having surface energies that promote or deter de-wetting of ink 30 from the inside walls of the inner chamber.

The cross-section of second outlet 38 may extend in a substantially horizontal plane. As further shown in FIG. 1, however, second outlet 38 may define a cross-sectional plane that extends upward such that the second outlet includes a lowermost point 46 and an uppermost point 48. In this case, the level of negative pressure within inner chamber 18 can be set to control the level of ink 30 at a height substantially equivalent to a height of the uppermost point 48 of second outlet 38. Thus, the height of uppermost point 48 sets the level of ink 30 within outer chamber 16. The upward angle of second outlet 38 can be selected to meter the flow of ink 30 out of inner chamber 18.

Like outlet diameter, the angle of second outlet 38 plays a role in setting the force necessary to break the surface tension exerted by ink 30 at the second outlet. In particular, the angle of second outlet 38 determines the size of the outlet area that is exposed as the ink level recedes within outer chamber 16. Consequently, the angle can be varied to control the replenishment response of second outlet 38. For example, a larger angle relative to horizontal will decrease the forces needed to break the surface tension of the ink at second outlet 38, more readily allowing an air bubble to enter inner chamber 18 when the level of ink 30 within outer chamber 16 decreases. Thus, the angle of second outlet 38 can be preselected for inks having different viscosities or other fluid characteristics to control the rate of inflow of air and egress of ink 30 from inner chamber 18.

To control the pressure of ink delivered to inkjet printhead 12, pressure source 20 applies a selected level of negative pressure to outer chamber 16. Outer chamber 16 receives the negative pressure from pressure source 20 via a pressure delivery conduit 50. Pressure source 20 can be configured to apply an amount of negative pressure sufficient to substantially offset the amount of pressure exerted at inlet 34 to inkjet printhead 12 during steady state, i.e., during an inactive period in which the printhead is not jetting or between successive jetting intervals.

In this manner, pressure source 20 preferably is set to achieve substantially zero static pressure at nozzle plate 44 in steady state, thereby avoiding excessive wetting due to leakage of ink 30 form the nozzles. The pressure at nozzle plate 42 can be slightly negative or positive, however, so long as appreciable wetting does not occur at nozzle plate 42. In other words, pressure source 20 exerts a pressure generally sufficient to retain ink 30 within inkjet printhead 12. At the same time, the pressure applied by pressure source 20 is operative on a substantially constant level and volume of ink 30 within outer chamber 16 due to the replenishment function of inner chamber 18.

The ability to maintain the ink level and negative pressure together result in a very consistent static pressure from the ink supply, i.e., cartridge 14, to inlet 34 of inkjet printhead 12. Upon controlled jetting, the inkjet printhead 12 delivers an impulse pressure change that instantaneously overcomes the negative pressure applied by pressure source 20 to emit a finite droplet 42 of ink 30 onto a print medium. In the absence of excessive wetting at nozzle plate 44, the droplet 42 can be accurately jetted to the print medium.

To provide consistent nozzle pressure, pressure source 20 can be made selectively adjustable to control the level of negative pressure, and thereby control the static nozzle pressure of inkjet printhead 12. The negative pressure level applied by pressure source 20, like the diameter, volume, angle, and surfaces properties of second outlet 38, can be selectively adjusted according to the physical characteristics of ink 30, accounting for different fluid characteristics such as viscosity. Notably, the negative pressure level applied by pressure source 20 can be selected to operate on the substantially constant volume of ink 30 within outer chamber 16.

Further, the negative pressure level applied by pressure source 20 can be selectively adjusted based on physical characteristics of the inkjet printhead 12, such as the steady state drawing pressure exerted by the printhead at first outlet 32 of outer chamber 16. To that end, pressure source 20 may be preset in the factory for a particular ink and printhead, or configured to allow dynamic readjustment. This readjustment may be undertaken manually by a technician in the field or by an end user, or performed automatically in response to a system change such as a change in the type of ink 30 or printhead 32 being used with system 10.

Processor 22 can be provided to allow selective adjustment of the level of negative pressure applied by pressure source 20, either manually or automatically. In particular, processor 22 can access files stored in memory 24 on a selective basis to determine pressure levels appropriate for particular types of inks or inkjet printheads. Memory 24 may include random access memory (RAM) for temporary storage, in addition to the pressure files, of program code that is accessed and executed by processor 22 to carry out a pressure readjustment routine. The program code can be loaded into memory 24 from another memory device, such as a fixed hard drive or removable media device associated with system 10. Processor 22 may take the form of any conventional general purpose single- or multi-chip microprocessor such as a Pentium® processor, a Pentium Pro® processor, an 8051 processor, a MIPS processor, a Power PC® processor, or an Alpha® processor. In addition, processor 22 may take the form of any conventional special purpose microprocessor. As an alternative, processor 22 could realized by discrete logic circuitry or a microcontroller.

Processor 22 can be configured to allow an end user to manually select files from memory 24 via user input device 26, which may take the form of a keyboard and pointing device, e.g., a mouse, trackball, or touch screen, and may include a computer monitor that provides text or graphical user interface. Alternatively, the user can employ input device 26 to enter new pressure files or select particular pressure levels for pressure source 20. In this latter case, input device 26 could take the form of a simple dial or a set of buttons provided on a control panel for system 10. As a further alternative, processor 22 may automatically select files from memory 24 based on data processed by reader 28. For example, reader 28 may take the form of an optical or magnetic scanner that identifies a particular type of ink contained within cartridge 14 or a particular type of inkjet printhead, e.g., by reference to a bar code or magnetic strip carried by the cartridge or printhead. Processor 22, memory 24, input device 26, and reader device 28 can be constructed as discrete devices that are communicatively coupled to facilitate the readjustment routine. In many applications, however, processor 22, memory 24, input device 26, and reader device 28 may be integrated with or form part of a personal computer or computer workstation, and share a common communication bus.

With the ability to detect the type of ink or printhead being used in system 10, processor 22 may select the level of negative pressure applied to outer chamber 16 automatically according to the individual characteristics of the particular ink or printhead, or both. Moreover, different levels of negative pressure can be selected for different ink colors or manufacturers, as appropriate, depending on differing physical characteristics between colors or manufacturers. Schemes for adjustment of the negative pressure level applied to outer chamber 16 can be developed for different mixtures of inks, e.g., for formulation of special process colors. Also, the negative pressure level applied to outer chamber 16 can be adjusted for other fluids, or fluid mixtures, e.g., solvents applied to clean printhead 12 or other elements within system 10. In this case, when cleaning is desired, inner chamber 18 can be filled with a cleaning solvent and installed in system 10 as a cleaning cartridge in place of an ink cartridge. Of course, the characteristics of different inks also may warrant different levels of pressure within inner chamber 18. Inasmuch as inner chamber 18 serves as the ink supply reservoir, however, the internal level of negative pressure could be preset when inner chamber is filled, e.g., at the factory or by a print technician.

Figure 2:
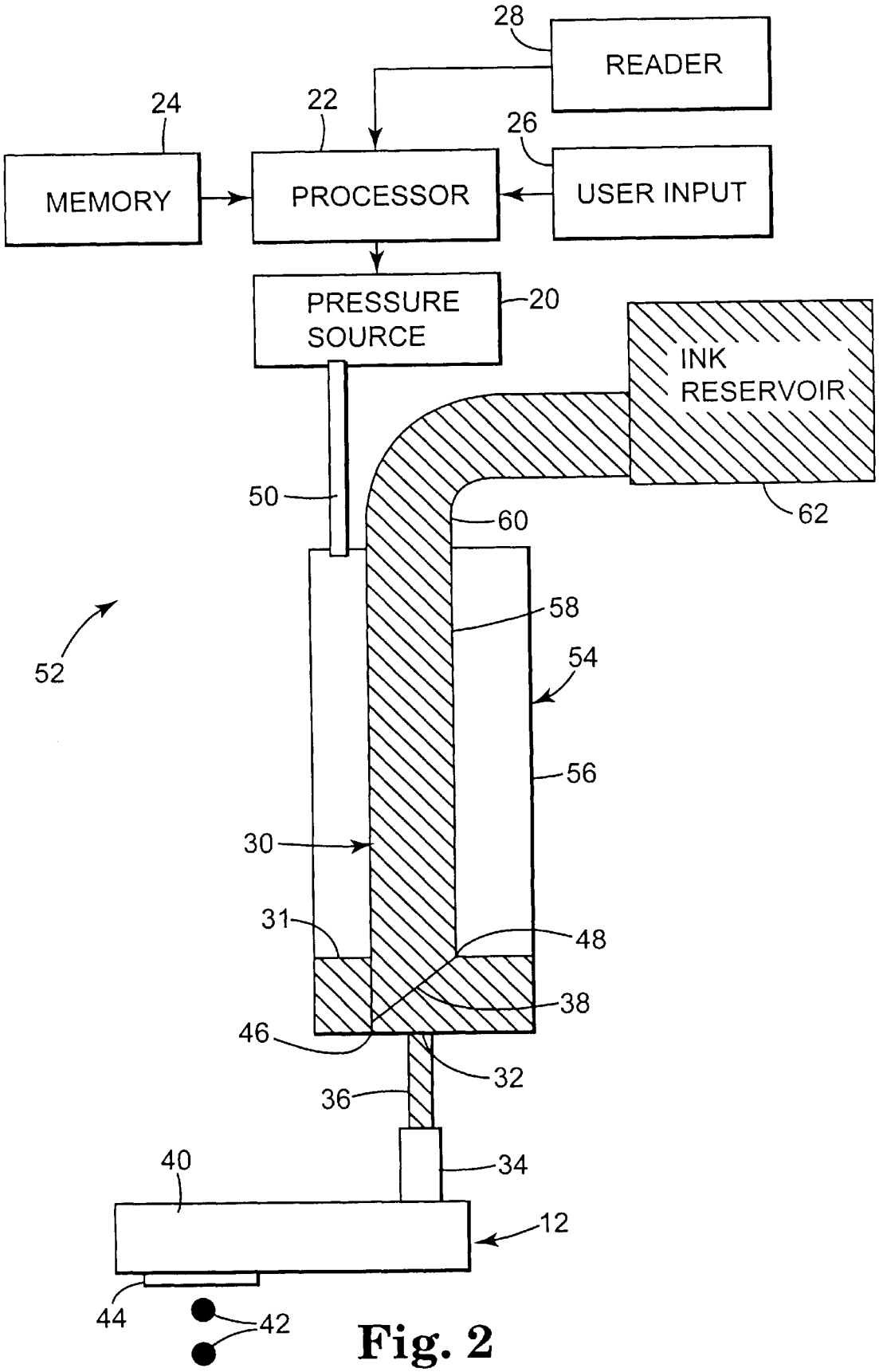
FIG. 2 is a diagram of another system for controlling ink delivery pressure in a printing system.

FIG. 2 is a diagram of another system 52 for controlling ink delivery pressure in a printing system. System 52 conforms substantially to system 10 of FIG. 1, but represents an embodiment that makes use of a bulk delivery cartridge 54 for delivery of ink 30 to inkjet printhead 12. Cartridge 54 incorporates both an outer chamber 56 and an inner chamber 58, which operate in a manner substantially similar to outer chamber 16 and inner chamber 18 of system 10. Inner chamber 58 is coupled, however, via an elongated conduit 60 to a larger ink supply reservoir 62 that is housed separately from outer chamber 56. The larger ink supply reservoir 62 provides a relatively larger volume of ink to cartridge 54 to reduce the frequency of replenishment. Indeed, ink supply reservoir 62 can be configured for periodic replenishment to avoid the need to disconnect cartridge 54 or otherwise alter system 52. This delivery concept provides large reserves of ink, which are particularly advantageous for high volume printing applications. Bulk supply reservoir 62 can be constructed for stationary mounting within a printing system. Conduits 50, 60 can be constructed as elongated, flexible conduits that allow inkjet printhead 12 to travel without restriction relative to bulk supply reservoir 62. Further, it is conceivable that cartridge 54 could be constructed for stationary mounting, and connected to the traveling printhead 12 via conduit 36, which could be elongated and flexible. Accordingly, like system 10, system 52 can be adapted for use with commercially available or new printheads 12 having an inlet 34 for receipt of ink from an external source.

Inner chamber 58 may take the form of a discrete chamber that is coupled to conduit 60, or simply form a portion of the conduit that extends into outer chamber 56. In either case, inner chamber 58 receives ink from supply reservoir 62 and, in turn, delivers the ink to outer chamber 56. As in system 10, pressure source 20 applies a selected level of negative pressure to outer chamber 56. Similarly, ink supply reservoir 62 maintains an internal negative pressure that is operative to allow delivery of ink from inner chamber 58 in a controlled manner, and thereby maintain the ink within outer chamber 56 at a desired level 31. The negative pressure within ink supply reservoir 62 can be established by partially evacuating the reservoir via a valve or fitting. Alternatively, ink supply reservoir 62 could be coupled to pressure source 20 or another pressure source for continuous, active pressure control. In any event, the negative pressure within ink supply reservoir 62 is selected to maintain the ink level 31 at a height substantially equivalent to a height of second outlet 38 within outer chamber 56. In this manner, the negative pressure within outer chamber 56 will be operative on a substantially constant volume of ink 30. Accordingly, system 52, with the exception of delivery of ink from supply reservoir 62 to inner chamber 58, functions like system 10 in substantially all respects.

A number of embodiments of the present invention have been described. Nevertheless, it will be understood that various modifications may be made without departing from the spirit and scope of the invention. Accordingly, other embodiments are within the scope of the following claims.

What is claimed is:

1. A system for controlling delivery of ink to an ink printing mechanism, the system comprising:

an outer chamber having a first outlet for delivery of ink from the outer chamber to an ink printing mechanism;

an inner chamber having a second outlet disposed within the outer chamber for delivery of the ink from the inner chamber to the outer chamber, wherein the inner chamber is negatively pressurized to control a level of the ink within the outer chamber; and a pressure source that provides negative pressure to the outer chamber, independently of the negative pressure in the inner chamber, to control a static pressure of the ink delivered to the ink printing mechanism.

2. The system of claim 1, wherein the inner chamber has a negative internal pressure selected to maintain a Substantially constant level of ink within the outer chamber.

3. The system of claim 1, wherein the second outlet is oriented to deliver the ink downward into the outer chamber.

4. The system of claim 1, wherein the ink printing mechanism is an inkjet printhead having an output nozzle, the output nozzle emitting ink at a nozzle pressure determined by a level of pressure exerted by the inkjet printhead on ink delivered from the outer chamber during a static period and a level of the negative pressure applied to the outer chamber by the pressure source, further comprising means for selectively adjusting the pressure source to control the level of the negative pressure applied to the outer chamber and thereby control the static nozzle pressure of the inkjet printhead.

5. The system of claim 1, further comprising means for selectively adjusting the pressure source to control the level of the negative pressure applied to the outer chamber based on physical characteristics of the ink.

6. The system of claim 1, further comprising means for selectively adjusting the pressure source to control the level of the negative pressure applied to the outer chamber based on physical characteristics of the ink printing mechanism.

7. The system of claim 1, wherein a level of negative pressure within the inner chamber is sufficient such that, upon delivery of an amount of ink from the outer chamber to the ink printing mechanism, a corresponding amount of ink is delivered from the inner chamber to the outer chamber, thereby maintaining a level of the ink within the outer chamber.

8. The system of claim 1, wherein the inner chamber has a closed upper portion and an open lower portion defined by the second outlet, the second outlet having a cross-sectional plane that extends upward relative to the lower portion of the inner chamber such that the second outlet includes a lowermost point and an uppermost point, the cross-sectional plane extending at a non-perpendicular angle relative to a direction which ink is delivered from the inner chamber to the outer chamber, wherein a level of the negative pressure within the inner chamber is sufficient to control the level of the ink within the outer chamber at a height substantially equivalent to a height of the uppermost point of the second outlet.

9. The system of claim 1, wherein the inner chamber has a closed upper portion and an open lower portion defined by the second outlet, the second outlet having a cross-sectional plane that extends upward relative to the lower portion of the inner chamber such that the second outlet includes a lowermost point and an uppermost point, the cross-sectional plane extending at a non-perpendicular angle relative to a direction in which ink is delivered from the inner chamber to the outer chamber, wherein a level of the negative pressure within the inner chamber is sufficient such that, upon delivery of an amount of ink from the outer chamber to the ink printing mechanism, a corresponding amount of ink is delivered from the inner chamber to the outer chamber, thereby maintaining a level of the ink within the outer chamber at a level substantially equivalent to a height of the uppermost point of the second outlet within the outer chamber.

10. The system of claim 1, wherein the second outlet is sized such that, when the level of ink within the outer chamber recedes, force generated by surface tension of ink within the second outlet is overcome, thereby allowing delivery of ink from the inner chamber to the outer chamber to maintain the level of the ink within the outer chamber.

11. The system of claim 1, wherein the inner chamber includes an ink reservoir disposed outside of the inner chamber and a conduit extending between the ink reservoir and the second outlet, the conduit delivering ink from the ink reservoir to the second outlet, wherein a portion of the conduit is disposed within the outer chamber.

12. The system of claim 11, wherein the second outlet has a cross-sectional plane that extends upward relative to the lower portion of the inner chamber such that the second outlet includes a lowermost point and an uppermost point, the pressure source applying a level of the negative pressure to the outer chamber to control the level of the ink at a height substantially equivalent to a height of the uppermost point of the second outlet.

13. The system of claim 11, wherein a level of the negative pressure within the inner chamber is sufficient such that, upon delivery of an amount of ink from the outer chamber to the ink printing mechanism, a corresponding amount of ink is delivered from the inner chamber to the outer chamber, thereby maintaining a level of the ink within the outer chamber at a level substantially equivalent to a height of the second outlet within the outer chamber.

14. A method for controlling delivery of ink to an ink printing mechanism, the method comprising:

delivering ink from a first outlet of an outer chamber to an ink printing mechanism;

delivering ink from a second outlet of an inner chamber to the outer chamber, the inner chamber having a level of negative pressure that controls a level of the ink within the outer chamber; and applying negative pressure to the outer chamber, independently of the negative pressure in the inner chamber, to control a static pressure of the ink delivered to the ink printing mechanism.

15. The method of claim 14, further comprising selecting the negative pressure in the inner chamber to maintain a substrantially constant level of ink within the outer chamber.

16. The method of claim 14, wherein the second outlet is oriented to deliver the ink downward into the outer chamber.

17. The method of claim 14, wherein the ink printing mechanism is an inkjet printhead having an output nozzle, the output nozzle emitting ink at a static nozzle pressure determined by a level of pressure exerted by the inkjet printhead on ink delivered from the outer chamber in a static mode and a level of the negative pressure in the outer chamber, the method further comprising selectively adjusting the level of the negative pressure applied to the outer chamber to thereby control the static nozzle pressure of the inkjet printhead.

18. A method for controlling delivery of ink to an ink printing mechanism, the method comprising:

delivering ink from a first outlet of an outer chamber to an ink printing mechanism;

delivering ink from a second outlet of an inner chamber to the outer chamber, the inner chamber having a level of negative pressure that controls a level of the ink within the outer chamber;

applying negative pressure to the outer chamber to control a static pressure of the ink delivered to the ink printing mechanism, and selectively adjusting the level of the negative pressure applied to the outer chamber based on physical characteristics of the ink.

19. A method for controlling delivery of ink to an ink printing mechanism the method comprising;

delivering ink from a first outlet of an outer chamber to an ink printing mechanism;

delivering ink from a second outlet of an inner chamber to the outer chamber, the inner chamber having a level of negative pressure that controls a level of the ink within the outer chamber;

applying negative pressure to the outer chamber to control a static pressure of the ink delivered to the ink printing mechanism, and selectively adjusting the level of the negative pressure applied to the outer chamber based on physical characteristics of the ink printing mechanism.

20. The method of claim 14, further comprising selecting the level of the negative pressure within the inner chamber such that, upon delivery of an amount of ink from the outer chamber to the ink printing mechanism, a corresponding amount of ink is delivered from the inner chamber to the outer chamber, thereby maintaining a level of the ink within the outer chamber.

21. The method of claim 14, wherein the inner chamber has a closed upper portion and an open lower portion defined by the second outlet, the second outlet having a cross-sectional plane that extends upward relative to the lower portion of the inner chamber such that the second outlet includes a lowermost point and an uppermost point, the method further comprising selecting a level of the negative pressure within the inner chamber to control the level of the ink at a height substantially equivalent to a height of the uppermost point of the second outlet.

22. The method of claim 14, wherein the inner chamber has a closed upper portion and an open lower portion defined by the second outlet, the second outlet having a cross-sectional plane that extends upward relative to the lower portion of the inner chamber such that the second outlet includes a lowermost point and an uppermost point, the method further comprising selecting a level of the negative pressure within the inner chamber that is selected such that, upon delivery of an amount of ink from the outer chamber to the ink printing mechanism, a corresponding amount of ink is delivered from the inner chamber to the outer chamber, thereby maintaining a level of the ink within the outer chamber at a level substantially equivalent to a height of the uppermost point of the second outlet within the outer chamber.

23. A method for controlling delivery of ink to an ink printing mechanism, the method comprising:

delivering ink from a first outlet of an outer chamber to an ink printing mechanism;

delivering ink from a second outlet of an inner chamber to the outer chamber, the inner chamber having a level of negative pressure that controls a level of the ink within the outer chamber;

applying negative pressure to the outer chamber to control a static pressure of the ink delivered to the ink printing mechanism, and sizing the second outlet such that, when the level of ink within the outer chamber recedes, force generated by surface tension of ink within the second outlet is overcome, thereby allowing delivery of ink from the inner chamber to the outer chamber to maintain the level of the ink within the outer chamber.

24. A method for controlling delivery of ink to an ink printing mechanism, the method comprising:

delivering ink from a first outlet of an outer chamber to an ink printing mechanism;

delivering ink from a second outlet of an inner chamber to the outer chamber, the inner chamber having a level of negative pressure that controls a level of the ink within the outer chamber;

applying negative pressure to the outer chamber to control a static pressure of the ink delivered to the ink printing mechanism, and wherein the inner chamber includes an ink reservoir disposed outside of the inner chamber and a conduit extending between the ink reservoir and the second outlet, the method further comprising delivering ink from the ink reservoir to the second outlet via the conduit, wherein a portion of the conduit is disposed within the outer chamber.

25. The method of claim 24, wherein the second outlet has a cross-sectional plane that extends upward relative to the lower portion of the inner chamber such that the second outlet includes a lowermost point and an uppermost point, the method further comprising selecting a level of the negative pressure within the inner chamber to control the level of the ink at a height substantially equivalent to a height of the uppermost point of the second outlet.

26. The method of claim 24, further comprising applying a level of the negative pressure to the outer chamber that is selected such that, upon delivery of an amount of ink from the outer chamber to the ink printing mechanism, a corresponding amount of ink is delivered from the inner chamber to the outer chamber, thereby maintaining a level of the ink within the outer chamber at a level substantially equivalent to a height of the second outlet within the outer chamber.

27. A system for controlling delivery of ink to an ink printing mechanism, the system comprising:

an outer chamber for delivery of ink to an ink printing mechanism;

an inner chamber for delivery of ink to the outer chamber, wherein the inner chamber is negatively pressurized to maintain a substantially constant level of ink within the outer chamber; and a pressure source that applies negative pressure to the outer chamber, independently of the negative pressure in the inner chamber, to control a static pressure of the ink delivered to the ink printing mechanism.

28. A method for controlling delivery of ink to an ink printing mechanism, the method comprising:

delivering ink from a first outlet of an outer chamber to an ink printing mechanism;

delivering ink from a second outlet of an inner chamber to the outer chamber, the inner chamber having a level of negative pressure that helps maintain a substantially constant level of ink within the outer chamber; and applying negative pressure to the outer chamber, independently of the negative pressure in the inner chamber, to control a static pressure of the ink delivered to the ink printing mechanism.

29. A system for controlling delivery of a fluid to an ink printing mechanism, the system comprising:

an outer chamber for delivery of fluid to an ink printing mechanism;

an inner chamber for delivery of fluid to the outer chamber, wherein the inner chamber is negatively pressurized to maintain a substantially constant level of fluid within the outer chamber; and a pressure source that applies negative pressure to the outer chamber, independently of the negative pressure in the inner chamber, to control a static pressure of the fluid delivered to the ink printing mechanism.

30. A method for controlling delivery of fluid to an ink printing mechanism, the method comprising:

delivering fluid from a first outlet of an outer chamber to an ink printing mechanism;

delivering fluid from a second outlet of an inner chamber to the outer chamber, the inner chamber having a level of negative pressure that helps maintain a substantially constant level of fluid within the outer chamber; and applying negative pressure to the outer chamber, independently of the negative pressure in the inner chamber, to control a static pressure of the fluid delivered to the ink printing mechanism.

* * * * *